US005636010A

United States Patent [19]

Danzuka et al.

[11] Patent Number: 5,636,010

[45] Date of Patent: Jun. 3, 1997

[54] IMAGE FORMING APPARATUS HAVING A PLURALITY OF DEVELOPING MEANS

[75] Inventors: Toshimitsu Danzuka; Takeshi Menjo, both of Tokyo; Takao Ogata, Yokohama, all of Japan

[73] Assignee: Canon Kabushiki Kaisha, Tokyo, Japan

[21] Appl. No.: 578,447

[22] Filed: Dec. 26, 1995

Related U.S. Application Data

[63] Continuation of Ser. No. 464,524, Jun. 5, 1995, abandoned, which is a continuation of Ser. No. 98,832, Jul. 29, 1993, abandoned.

[30] Foreign Application Priority Data

Jul. 31, 1992 [JP] Japan ..... 4-224935

[51] Int. Cl.[6] ..... G03G 15/14

[52] U.S. Cl. ..... 399/300; 399/302

[58] Field of Search ..... 355/208, 245, 355/271, 272, 273, 326 R, 327

[56] References Cited

U.S. PATENT DOCUMENTS

| | | | |
|---|---|---|---|
| 4,712,906 | 12/1987 | Bothner et al. . | |
| 4,849,795 | 7/1989 | Spehrley, Jr. et al. | 355/271 X |
| 5,099,286 | 3/1992 | Nishise et al. | 355/272 |
| 5,111,242 | 5/1992 | Tanimoto et al. | 355/271 X |
| 5,117,261 | 5/1992 | Sakai et al. | 355/272 X |
| 5,189,478 | 2/1993 | Hara et al. | 355/271 |
| 5,249,024 | 9/1993 | Menjo | 355/271 X |

*Primary Examiner*—Sandra L. Brase

*Attorney, Agent, or Firm*—Fitzpatrick, Cella, Harper & Scinto

[57] ABSTRACT

An image forming apparatus has a movable image bearing member, a plurality of developing devices operable for development at different locations along the direction of movement of the image bearing member to develop the image bearing member with toners of plural colors, and a transfer medium carrying member for carrying a transfer medium thereon and conveying the transfer medium to a transfer position. The toner images of plural colors on the image bearing member are superposition-transferred onto the transfer medium carried on the transfer medium carrying member. The transfer medium carrying member is capable of carrying a plurality of transfer mediums at different locations thereon. When the maximum length of the respective gaps between adjacent ones of the plurality of developing devices along the direction of movement of the image bearing member is D, the peripheral velocity of the transfer medium carrying member is U, and the peripheral velocity of the image bearing member is V, at least one of the gaps between adjacent ones of the plurality of transfer mediums carried on the transfer medium carrying member is greater than D×U/V.

62 Claims, 2 Drawing Sheets

IMAGE FORMING APPARATUS HAVING A PLURALITY OF DEVELOPING MEANS

This application is a continuation of application Ser. No. 08/464,524, filed Jun. 5, 1995, which is a continuation of application Ser. No. 08/098,832, filed Jul. 29, 1993, both now abandoned.

BACKGROUND OF THE INVENTION

1. Field of the Invention

This invention relates to an image forming apparatus such as an electrophotographic apparatus or an electrostatic recording apparatus having a plurality of developing means and capable of forming color images.

2. Related Background Art

U.S. Pat. No. 4,712,906 discloses an image forming apparatus in which a plurality of developing means are disposed around a photosensitive member (that is, an image bearing member) along the direction of rotation thereof, and a plurality of transfer mediums of a size which permits a plurality of sheets to be carried on a transfer medium carrying member (transfer drum) are carried on the transfer drum at the same time to improve the number of image sheets output per unit time.

In this image forming apparatus, a charger, four developing devices of cyan, magenta, yellow and black, respectively, a transfer drum and a cleaner are disposed around a photosensitive belt. The diameter of the transfer drum is such that the transfer drum can carry two transfer mediums of the letter size thereon and form images thereon.

A cyan toner image, a magenta toner image and a yellow toner image each intended for two transfer mediums are successively formed on the photosensitive belt. The cyan toner image, the magenta toner image and the yellow toner image are transferred onto the two transfer mediums carried on the transfer drum. The toner images of the three colors are transferred onto the first and second transfer mediums carried on the transfer drum, whereafter the transfer mediums are separated one by one from the transfer drum and are sent to a fixing device.

In the above-described image forming apparatus, the interval between the two transfer mediums of the letter size carried on the transfer drum is smaller than the interval between the developing devices. Therefore, if three or more image sheets are output on end, there will be a time period in which a plurality of developing devices perform the developing operation at the same time.

When two developing devices are driven at the same time as described above, the torque required of a drive motor becomes great because the developing devices are generally driven by a single drive motor. Also, a developing bias must be applied to the two developing devices at the same time. Further, there is a drawback in that images are disturbed by the fluctuation of load.

SUMMARY OF THE INVENTION

It is an object of the present invention to provide an image forming apparatus which is high in image output speed.

It is another object of the present invention to provide an image forming apparatus in which a plurality of developing devices are prevented from operating at the same time.

It is still another object of the present invention to provide an image forming apparatus in which any image disturbance due to a fluctuation of the loads of a plurality of developing means is prevented.

Further objects and features of the present invention will become more fully apparent from the following detailed description taken in conjunction with the accompanying drawings.

DETAILED DESCRIPTION OF THE PREFERRED EMBODIMENTS

Some embodiments of the present invention will hereinafter be described with reference to the drawings.

Figure 4:
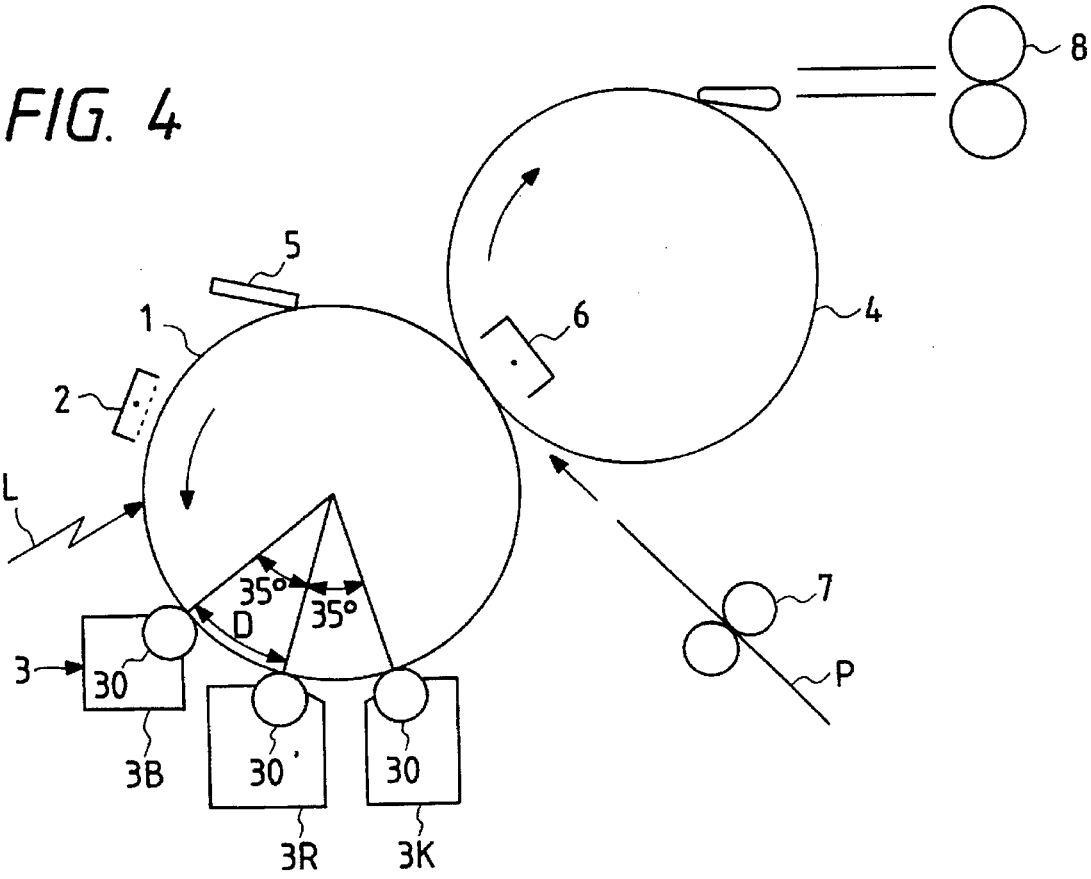
FIG. 4 schematically shows the construction of an image forming apparatus according to the prior art.

Referring to FIG. 4, which shows an example of a conventional image forming apparatus, the reference numeral 1 designates a photosensitive drum having a diameter of 160 mm. A primary charger 2, three developing devices 3, a transfer drum 4 having a diameter of 160 mm and a cleaner 5 are disposed around the photosensitive drum 1. A transfer charger 6 is disposed inside the image transfer portion of the transfer drum 4, which is opposed to the photosensitive drum 1, and a pair of register rollers 7 are disposed at a location short of the image transfer portion of the transfer drum 4 and the photosensitive drum 1. A fixing device 8 is disposed at a location spaced apart from a location opposite to the image transfer portion of the transfer drum 4. The diameter of the transfer drum 4 is determined taking into account that two transfer mediums of the letter size can be carried on the transfer drum and images can be formed thereon, and that the image forming apparatus is made compact.

The three developing devices 3 comprise a developing device 3K for black, a developing device 3R for red and a developing device 3B for blue, and adjacent ones of the developing devices are disposed in 35° spaced apart relationship with respect to the center of the photosensitive drum 1. Accordingly, the circumferential length D of the photosensitive drum 1 which corresponds to the gap between adjacent developing devices is $$D=160\times\pi\times35\div360=48.9\ (\text{mm}).$$

The developing device 3K for black, the developing device 3R for red and the developing device 3B for blue contain therein black toner, red toner and blue toner, respectively, as one-component developers, and are provided with respective developing sleeves 30 each containing a magnet roller therein. The developing devices 3K, 3R and 3B each are designed such that the respective developers are adsorbed and held on the outer peripheral portions of the developing sleeves 30 by the action of magnet rollers and the developing sleeves 30 are rotated to thereby convey the respective toners to the developing portions opposed to the photosensitive drum 1.

The operation of this image forming apparatus will now be described. The photosensitive drum 1 is first uniformly charged by the primary charger 2 and is twice exposed to image light L based on black image information from a scanner unit (not shown), whereby electrostatic latent images for black intended for two transfer mediums are formed on the photosensitive drum 1. These latent images are positioned at a location corresponding to the developing device 3K for black with the rotation of the photosensitive drum 1, supplied with black toner via developing sleeve 30 of the developing device 3K for black, and developed by the black toner, whereby visualized black toner images intended for two transfer mediums are successively obtained. On the other hand, two sheets of transfer paper P are successively fed from a cassette (not shown) and are supplied to the transfer drum 4, while being timed with the above-described black toner images, by the register rollers 7, and the two sheets of transfer paper P are successively adsorbed to the outer peripheral surface of the transfer drum 4 and are conveyed thereby. The two black toner images on the photosensitive drum 1 are then successively transferred onto the first and second sheets of transfer paper P, respectively, by the transfer charger 6 while the first and second sheets of transfer paper P on the transfer drum 4 pass the image transfer portion.

After termination of the transfer operation, any residual toner remaining on the photosensitive drum 1 is removed by the cleaner 5. The drum then is uniformly charged again by the primary charger 2 and is exposed to an image light L of red image information through the scanner unit, whereby latent images for red color intended for two transfer mediums are formed, and these latent images are developed by the red toner of the developing device 3R, and thus, red toner images intended for two transfer mediums are successively obtained. These red toner images are successively transferred onto the first and second sheets of transfer paper P onto which the black toner images have already been transferred. Likewise, latent images for color intended for two transfer mediums are formed on the photosensitive drum by exposure thereof to an image light L of blue image information and are developed by the developing device 3B for blue, whereby blue toner images intended for two transfer mediums are successively obtained, and these blue toner images are successively transferred onto the first and second sheets of transfer paper P onto which the black toner images and the red toner images previously have been transferred.

In the manner described above, three kinds of toner images are transferred onto the first and second transfer mediums in the named order, and the transfer mediums P onto which the transfer has been completed are successively separated from the transfer drum 4 and are conveyed to the fixing device 8, whereby the toner images on the transfer mediums P are fixed. If the above-described three developing devices are developing devices for yellow, magenta and cyan toners, those color toners can be superposed on transfer mediums to thereby form a full color image.

Now, in the above-described image forming apparatus, if three or more transfer mediums P of the letter size are carried on the transfer drum 4 at uniform intervals and are image-output on end, then there will sometimes be a time period in which, as shown in the example of the prior art, the plurality of developing devices must perform the developing operation at the same time. This is because if two transfer mediums of the letter size are uniformly carried on the transfer drum 4, then the length $M_L$ of the gap between the two transfer mediums (in the same direction as the circumferential direction of the transfer drum 4) is $$M_L=160\times\pi\div2-216=35.3\ (\text{mm}).$$

This is shorter than the aforementioned D (the circumferential length of the photosensitive drum which corresponds to the gap between adjacent developing devices).

That is, if the peripheral velocities of the photosensitive drum and the transfer drum are equal to each other and the above-mentioned length $M_L$ is shorter than D, then when after a developing operation of a certain developing device (called X), a developing operation of an upstream developing device (called Y) disposed upstream of the developing device X with respect to the direction of rotation of the photosensitive drum is performed, the development of a latent image of the next color (called y) intended for the first transfer medium by the upstream developing device Y is started before the downstream developing device X terminates the development of a latent image (called x) for the second transfer medium. Since the peripheral velocity (U) of the transfer drum 4 and the peripheral velocity (V) of the photosensitive drum 1 are set to the same velocity, the length $M_L$ of the gap between the two transfer mediums in the circumferential direction of the transfer drum is substantially equal to the length of the non-latent image region between the latent images x and y in the circumferential direction of the photosensitive drum.

If the developing operations of the developing devices are performed from the upstream side with respect to the direction of rotation of the photosensitive drum 1, then when the number of output image sheets is up to two, it will never happen that the plurality of developing devices perform their developing operations at the same time. However, when three or more sheets are to be image-output on end, after a developing operation of the developing device 3B disposed most downstream for developing the toner image to be transferred last onto a transfer medium, the developing operation of the developing device 3K disposed most upstream for developing the toner image to be first transferred onto the transfer medium newly adsorbed to the transfer drum 4 with the length $M_L$=35.5 mm of the gap between the transfer mediums (such adsorption with the length $M_L$=35.5 mm is preferable for the purpose of improving the image forming speed) must be performed. As a result, the two developing devices 3B and 3K are driven at the same time, and there is a time period in which the developing operations are performed.

Description will now be made of an embodiment for preventing the developing operations of a plurality of developing devices from being performed at the same time.

Figure 1:
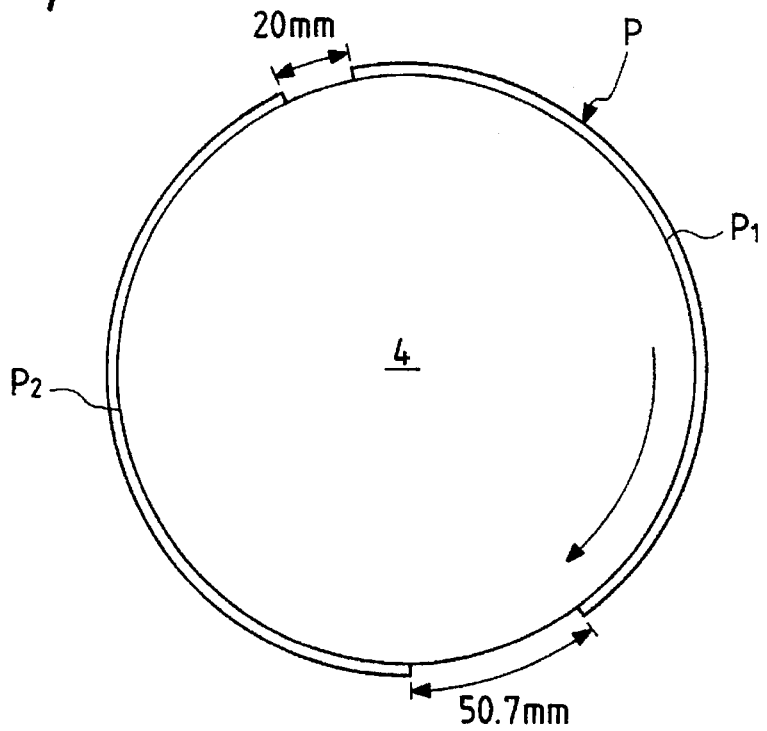
FIG. 1 is an illustration showing the manner in which transfer mediums are carried on a transfer drum in an embodiment of an image forming apparatus according to the present invention.

FIG. 1 is an illustration showing the manner in which transfer mediums are carried on a transfer drum in an embodiment of the image forming apparatus of the present invention. In the present embodiment, as shown in FIG. 1, the first and second transfer mediums $P_1$ and $P_2$ are non-uniformly carried on the transfer drum 1 when in the image forming apparatus shown in FIG. 4, two transfer mediums of the letter size are to be carried on the transfer drum 4. Accordingly, the present embodiment will hereinafter be described with reference to FIG. 4 as required, but the construction and operation of the image forming apparatus itself are as already described and therefore need not be described hereinafter.

Now, as previously described, the photosensitive drum 1 and transfer drum 4 shown in FIG. 4 have a diameter of 160 mm and the peripheral velocity (V) of the photosensitive drum 1 and the peripheral velocity (U) of the transfer drum 4 are set to the same velocity. Also, the developing device 3K for black, the developing device 3R for red and the developing device 3B for blue around the photosensitive drum 1 are disposed in 35° spaced apart relationship with one another, and the circumferential length D of the photosensitive drum 1 which corresponds to the gap between adjacent ones of the developing devices 3 is 48.9 mm.

According to the present embodiment, transfer mediums $P_1$ and $P_2$ of the letter size each having a length of 216 mm in the same direction as the circumferential direction of the transfer drum 4 are carried on the transfer drum 4 having a circumferential length of 502.7 mm ($160\times\pi=502.7$) with a gap of 50.7 mm greater than the gap D=48.9 mm between adjacent developing devices 3 being provided between the leading end of the first transfer medium $P_1$ and the trailing end of the second transfer medium $P_2$. The gap between the trailing end of the first transfer medium $P_1$ and the leading end of the second transfer medium $P_2$ is 20 mm ($502.7-216\times2-50.7=20$).

In the present embodiment, the first and second transfer mediums $P_1$ and $P_2$ are carried on the transfer drum 4 in the manner described above, and on the other hand, development is effected in such a manner that the latent image of the first color for the first transfer medium $P_1$ is first developed, and then the latent image of the first color for the second transfer medium $P_2$ is developed. The development of the latent images for these two transfer mediums is effected from the first to third colors by the developing devices 3K - 3B of FIG. 4. At that time, the first, second and third colors are in the order of black, red and blue, and the developing operations are performed by the developing devices 3K, 3R and 3B downstream with respect to the direction of rotation of the photosensitive drum 1 in the named order.

According to this, the length of the non-latent image area between the latent image x for the second transfer medium $P_2$ to be developed by the downstream developing device X and the next latent image y for the first transfer medium $P_1$ to be developed by the developing device Y upstream of the downstream developing device X is 50.7 mm as mentioned above and is greater than the gap D=48.9 mm between the developing devices X and Y. Therefore, at a point of time whereat the development of the latent image x by the developing device X is terminated, the latent image y of the next color has not yet arrived at the developing device Y and thus, there is not present a time period in which the developing devices X and Y are driven at the same time.

Generally, when the circumferential length of the transfer drum 4 is T, the maximum length of the gap between adjacent ones of the plurality of developing devices 3 in the circumferential direction of the photosensitive drum is D, the peripheral velocity of the transfer drum 4 is U, and the peripheral velocity of the photosensitive drum is V, such n or less sheets of transfer mediums P that the length Q in the same direction as the circumferential direction of the transfer drum 4 satisfying the equation $$Q<(T-D\times U/V)/n$$

are carried on the transfer drum 4, and at least one of the gaps between adjacent ones of the transfer mediums is made longer than $$D\times U/V,$$

and the order of the developing operations of the plurality of developing devices 3 is determined to be from the downstream side with respect to the direction of rotation of the photosensitive drum 1, whereby the time period in which the plurality of developing devices 3 are driven at the same time can be eliminated.

After in the manner described above, the transfer of three toner images is terminated in the order of the first transfer medium $P_1$ and the second transfer medium $P_2$, the first and second transfer mediums $P_1$ and $P_2$ onto which the transfer has been terminated can be separated from the transfer drum 4 in the named order and conveyed to the fixing device 8, where the fixing of the toner images on the transfer mediums can be effected.

In the present embodiment, the time period in which the developing operations of the plurality of developing devices are performed at the same time is eliminated. Thus, any increase in the torque of a single motor for driving these developing devices can be eliminated. Also, any image disturbance or the like by the fluctuation of load can be prevented.

Figure 2:
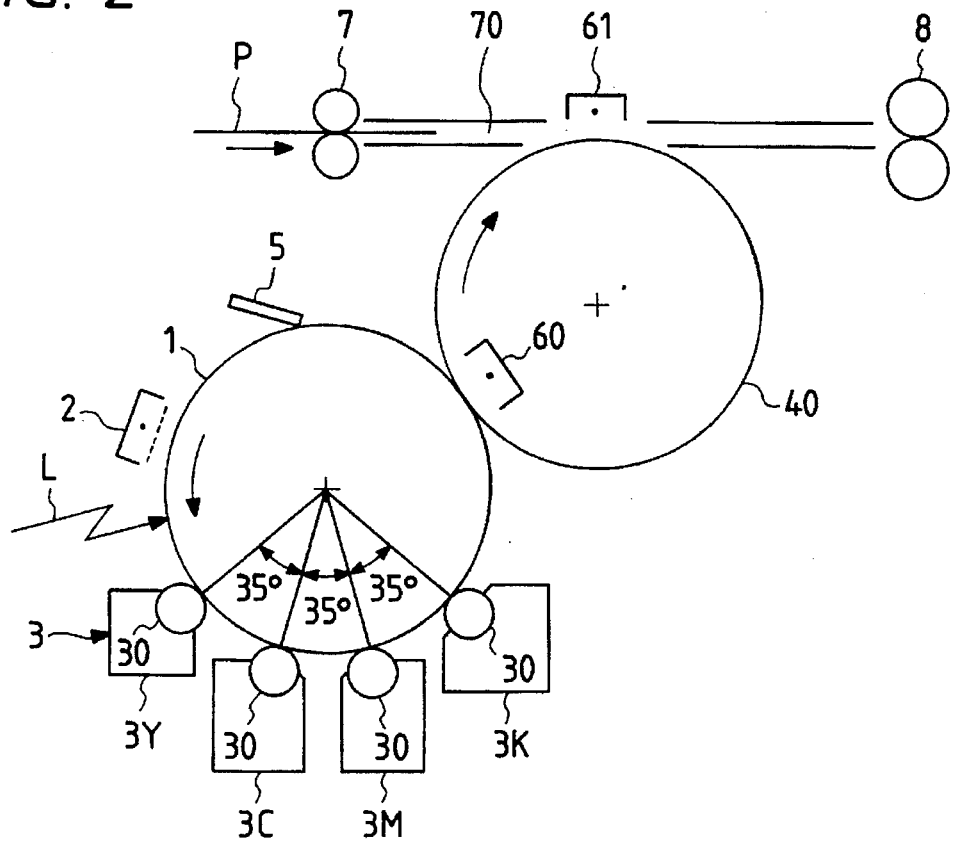
FIG. 2 schematically shows the construction of another embodiment of the image forming apparatus according to the present invention.

FIG. 2 schematically shows the construction of another embodiment of the image forming apparatus of the present invention. A great feature of this embodiment is that the transfer drum is eliminated and an intermediate transfer member 40 is provided.

The intermediate transfer member 40 comprises a cylindrical member having the same outer diameter 160 mm as that of the photosensitive drum 1, and the peripheral velocity thereof is also the same as that of the photosensitive drum 1. Transfer chargers 60 and 61 are installed inside and outside, respectively, of the intermediate transfer member 40, and the transfer charger 60 is disposed at a location within the intermediate transfer member 40 which is opposed to the photosensitive drum 1 so as to transfer toner images on the photosensitive drum 1 onto the intermediate transfer member 40. The other transfer charger 61 is disposed on a transfer medium conveyance path 70 leading from the register rollers 7 to the fixing device 8 so as to transfer toner images on the intermediate transfer member 40 onto a sheet-like transfer medium P supplied from the register rollers 7.

Four developing devices 3 are disposed around the photosensitive drum 1. That is, a developing device 3Y for yellow, a developing device 3C for cyan, a developing device 3M for magenta and a developing device 3K for black are arranged in the named order from the upstream side with respect to the direction of rotation of the photosensitive drum 1.

Again in the present embodiment, correspondingly to the embodiment shown in FIG. 1, two images of the letter size comprising toner images of four colors superposed one upon another are successively formed on the intermediate transfer member 40 by the transfer of toner images formed on the photosensitive drum 1. At that time, the two images of the letter size are formed in such a manner that a gap of 50.7 mm is provided between the leading end of the first image and the trailing end of the second image and a gap of 20 mm is provided between the trailing end of the first image and the leading end of the second image.

Also, on the photosensitive drum 1, the development of the latent images of the first to fourth colors is effected by the developing devices 3K - 3Y, in the order of the development of the latent image of the first color for the first image, and then the development of the latent image of the first color for the second image, and at that time, the first color, the second color, the third color and the fourth color are determined in the order of black, magenta, cyan and yellow and the developing operations are performed by the developing devices 3K, 3M, 3C and 3Y in the named order from the downstream side with respect to the direction of rotation of the photosensitive drum 1.

After in the manner described above, the superposition transfer of the toner images of four colors onto the intermediate transfer member 40 is terminated in the order of such as the first image and the second image, the two images successively obtained can be successively transferred onto the first transfer medium and the second transfer medium supplied by the register rollers 7 in the named order, and those transfer mediums can be conveyed to the fixing device 8, where fixing of the toner images on the transfer mediums can be effected.

Thus, again in the present embodiment, the time period in which the plurality of developing devices are driven at the same time can be eliminated. Accordingly, any increase in the torque of a single motor for driving these developing devices can be eliminated. Also, any image disturbance or the like by the fluctuation of load can be prevented.

Generally, when the circumferential length of the intermediate transfer member 40 is, the maximum length of the gap between adjacent ones of the plurality of developing devices 3 in the circumferential direction of the photosensitive drum is, the peripheral velocity of the intermediate transfer member 40 is, and the peripheral velocity of the photosensitive drum 1 is v, transfer is effected onto the intermediate transfer member 40 so that at least one of the gaps between adjacent ones of such n or less toner images that the length q in the same direction as the circumferential direction of the intermediate transfer member satisfying the equation $$q<(t-d\times u/v)/n$$

may be longer than $$d\times u/v,$$

and the order of the developing operations of the plurality of developing devices 3 is determined to be from the downstream side with respect to the direction of rotation of the photosensitive drum 1, whereby the time period in which the plurality of developing devices 3 are driven at the same time can be eliminated.

Figure 3:
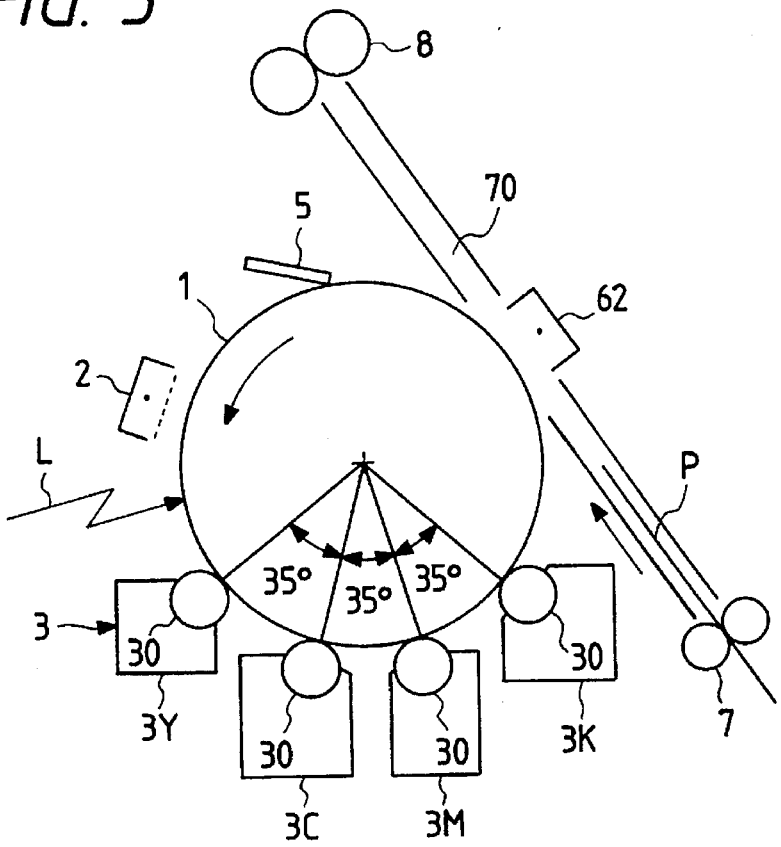
FIG. 3 schematically shows the construction of still another embodiment of the image forming apparatus according to the present invention.

FIG. 3 schematically shows the construction of still another embodiment of the image forming apparatus of the present invention. In this embodiment, neither of the transfer drum and the intermediate transfer member is installed and a multiplex development and collective transfer system is adopted. A transfer charger 62 is installed outside the photosensitive drum 1, and a transfer medium conveyance path 70 leading from the register rollers 7 to the fixing device 8 is disposed through the transfer charger 62.

The developing devices 3 around the photosensitive drum 1, as in the embodiment shown in FIG. 2, are the developing device 3Y for yellow, the developing device 3C for cyan, the developing device 3M for magenta and the developing device 3K for black from the upstream side with respect to the direction of rotation of the photosensitive drum 1.

Again in the present embodiment, correspondingly to the embodiment shown in FIG. 1, two images of the letter size comprising toner images of four colors superposed one upon another by development by the developing devices 3K - 3Y are successively formed on the photosensitive drum 1. At that time, the two images of the letter size are likewise formed in such a manner that a gap of 50.7 mm is provided between the leading end of the first image and the trailing end of the second image and a gap of 20 mm is provided between the trailing end of the first image and the leading end of the second image.

Also, on the photosensitive drum 1, the development of the latent images of the first to fourth colors is effected by the developing devices 3K - 3Y, in the order of the development of the latent image of the first color for the first image, and then the development of the latent image of the first color for the second image, and at that time, the first color, the second color, the third color and the fourth color are determined to be in the order of black, magenta, cyan and yellow, and the developing operations are performed by the developing devices 3K, 3M, 3C and 3Y in the named order from the downstream side with respect to the direction of rotation of the photosensitive drum 1.

After in the manner described above, the formation of toner images of four colors on the photosensitive drum 1 is terminated in the order of such as the first image and the second image, two images successively obtained can be successively transferred onto the first transfer medium and the second transfer medium successively supplied by the register rollers 7, and those transfer mediums can be conveyed to the fixing device 8, where the fixing of the toner images on the transfer mediums can be effected.

Thus, again in the present embodiment, the time period in which the plurality of developing devices are driven at the same time can be eliminated and accordingly, any increase in the torque of a single motor for driving these developing devices can be eliminated. Also, any image disturbance or the like by the fluctuation of load can be prevented.

Generally, when the circumferential length of the photosensitive drum 1 is $\tau$ and the maximum length of the gap between adjacent ones of the plurality of developing devices 3 in the circumferential direction of the photosensitive drum is $\delta$, such n or less toner images that the length $\rho$ in the same direction as the circumferential direction of the photosensitive drum satisfying the equation $$\rho<(\tau-\delta)/n$$

are formed on the photosensitive drum 1 so that at least one of the gaps between adjacent ones of said toner images may be longer than $\delta$, and the order of the developing operations of the plurality of developing devices 3 is determined to be from the downstream side with respect to the direction of rotation of the photosensitive drum 1, whereby the time period in which the plurality of developing devices 3 are driven at the same time can be eliminated.

As described above, a plurality of transfer mediums are carried on the transfer medium carrying member in such a manner that a gap larger than the maximum length of the gap between adjacent ones of the plurality of developing means around the image bearing member in the circumferential direction of the image bearing member is provided between the leading end of the first transfer medium and the trailing end of the last transfer medium. As a result, the order of the operations of the developing means is determined to be from the downstream side with respect to the direction of rotation of the image bearing member, whereby development can be effected without creating a time period in which the plurality of developing devices are driven at the same time, and toner images for the plurality of transfer mediums can be obtained for respective colors on the image bearing member, and by the transfer of the toner images, images of plural colors can be formed on the plurality of transfer mediums. Accordingly, an increase in the image output speed by the image formation being effected with the plurality of transfer mediums carried on the transfer medium carrying member can be achieved without hindrance, and any increase in the torque of the single motor for driving the plurality of developing means can be eliminated. Also, any image disturbance or the like by the fluctuation of load can be prevented.

Also, where an intermediate transfer member is provided instead of the transfer medium carrying member and toner images of respective colors for a plurality of transfer mediums are successively formed on the image bearing member and the toner images of respective colors formed on the image bearing member are once superposed one upon another and transferred onto the intermediate transfer member to thereby form images of plural colors and these images are again collectively transferred onto the transfer mediums to thereby obtain images of plural colors, the plurality of images of plural colors are formed on the intermediate transfer member in such a manner that a gap larger than the maximum length of the gap between adjacent ones of the plurality of developing means around the image bearing member in the circumferential direction of the image bearing member is provided between the leading end of the first image and the trailing end of the last image. As a result, the order of the operations of the plurality of developing means is determined to be from the downstream side with respect to the direction of rotation of the image bearing member, whereby development is effected by the developing means without creating the time period in which the plurality of developing means are driven at the same time, and toner images for the plurality of transfer mediums can be successively obtained for respective colors on the image bearing member, and by the transfer of these toner images onto the intermediate transfer member and further transfer thereof onto the transfer mediums, images of plural colors can likewise be formed on the plurality of transfer mediums.

Further, where neither of the transfer medium carrying member and the intermediate transfer member is installed and by multiplex development, images of plural colors comprising toner images of respective colors superposed one upon another are directly formed on the image bearing member and those images are collectively transferred onto the transfer mediums to thereby obtain images of plural colors, the plurality of images of plural colors are formed on the image bearing member in such a manner that a gap larger than the maximum length of the gap between adjacent ones of the plurality of developing means around the image bearing member in the circumferential direction of the image bearing member is provided between the leading end of the first image and the trailing end of the last image. As a result, the order of the operations of the plurality of developing means is determined to be from the downstream side with respect to the direction of rotation of the image bearing member, whereby development is effected by the developing means without creating a time period in which the plurality of developing means are driven at the same time, and thus, toner images for the plurality of transfer mediums can be successively obtained for respective colors on the image bearing member, and that by the transfer of those toner images onto the transfer mediums, images of plural colors can likewise be formed on the plurality of transfer mediums.

In FIGS. 2 to 4, the intervals between the developing devices are all equal, but of course, they may differ from one another. Also, in FIG. 1, the intervals between the transfer mediums differ from each other, but may be equal to each other. The transfer drum of FIG. 1 may have a circumferential length capable of carrying three or more transfer mediums thereon. Also, in FIG. 1, even when a transfer medium is carried on the transfer drum, the length of that portion of the transfer drum which carries no transfer medium thereon is greater than D×U/V. Likewise, even when a toner image is borne on the intermediate transfer member, the length of that portion of the intermediate transfer member which bears no image thereon is greater than d×u/v.

The present invention is not restricted to the above-described embodiments, but can be modified into any form within the scope of the technical idea of the present invention.

What is claimed is:

1. An image forming apparatus comprising:

a movable image bearing member for bearing images to be developed;

a plurality of developing means operable for development at different locations along a peripheral surface of said image bearing member to develop images on said image bearing member with toners of plural colors; and a transfer medium carrying member for carrying a transfer medium thereon and conveying the transfer medium to a transfer position, developed toner images of plural colors on said image bearing member being superposition-transferred onto a transfer medium carried on said transfer medium carrying member, said transfer medium carrying member being capable of carrying a plurality of transfer mediums at different locations thereon, with respective gaps therebetween;

wherein, when a maximum length of a gap between adjacent ones of said plurality of developing means along the peripheral surface of said image bearing member is D, a peripheral velocity of said transfer medium carrying member is U, and a peripheral velocity of said image bearing member is V, at least one of respective gaps between adjacent ones of the plurality of transfer mediums carried on said transfer medium carrying member is greater than D×U/V.

2. An image forming apparatus according to claim 1, wherein said plurality of developing means do not perform respective developing operations simultaneously at any time.

3. An image forming apparatus according to claim 1, wherein the number of said plurality of developing means is greater than three, and the order of developing operations of said plurality of developing means is determined to be from a downstream one toward an upstream one along the peripheral surface of said image bearing member, and then from a most upstream one to a most downstream one along the peripheral surface.

4. An image forming apparatus according to one of claims 1 or 3 wherein the gaps between adjacent ones of the plurality of transfer medium when carried on said transfer medium carrying member include a first gap and a second gap larger than said first gap, said second gap being greater than D×U/V.

5. An image forming apparatus according to claim 4, wherein said plurality of developing means includes first and second developing means, and when an area of said image bearing member which corresponds to said second gap is at a developing position in advance, a developing operation is changed over from said first developing means to said second developing means.

6. An image forming apparatus according to claim 1, wherein when a circumferential length of said transfer medium carrying member is T, a length of the transfer medium in a direction of movement of said transfer medium carrying member is Q, and the number of transfer mediums carried on said transfer medium carrying member is n, $Q<(T-D\times U/V)/n$ is satisfied.

7. An image forming apparatus according to claim 1, further having a common drive source for driving said plurality of developing means.

8. An image forming apparatus according to claim 1, which is capable of forming a full color toner image on the transfer medium.

9. An image forming apparatus according to claim 1, wherein when only one transfer medium is carried on said transfer medium carrying member, a gap between areas of said transfer medium carrying member on which no transfer medium is carried in a direction of movement of said transfer medium carrying member is greater than $D\times U/V$.

10. An image forming apparatus comprising:

a movable image bearing member for bearing images to be developed;

a plurality of developing means operable for development at different locations along a peripheral surface of said image bearing member to develop images on said image bearing member with toners of plural colors; and an intermediate transfer member onto which toner images of plural colors on said image bearing member are transferred, said intermediate transfer member being capable of bearing a plurality of toner images at different locations thereon with respective gaps therebetween, the toner images on said intermediate transfer member being transferred onto a transfer medium;

wherein when a maximum length of respective gaps between adjacent ones of said plurality of developing means along the peripheral surface of said image bearing member is d, a peripheral velocity of said intermediate transfer member is u, and a peripheral velocity of said image bearing member is v, at least one of the respective gaps between adjacent ones of the plurality of toner images borne on said intermediate transfer member is greater than $d\times u/v$.

11. An image forming apparatus according to claim 10, wherein said plurality of developing means do not perform respective developing operations simultaneously at any time.

12. An image forming apparatus according to claim 10, wherein the order of developing operations of said plurality of developing means is determined to be from a downstream one toward an upstream one along the peripheral surface of said image bearing member, and then from a most upstream one to a most downstream one along the peripheral surface of said image bearing member.

13. An image forming apparatus according to one of claims 10 or 12, wherein the gaps between adjacent ones of the plurality of toner images borne on said intermediate transfer member include a first gap and a second gap larger than said first gap, said second gap being greater than $d\times u/v$.

14. An image forming apparatus according to claim 13, wherein said plurality of developing means include first and second developing means, and when an area of said image bearing member which corresponds to said second gap is at a developing position in advance, a developing operation is changed over from said first developing means to said second developing means.

15. An image forming apparatus according to claim 10, wherein when a circumferential length of said intermediate transfer member is t, a length of a toner image along the peripheral surface of said image bearing member is q, and the member of toner images borne on said intermediate transfer member is n, $q<(t-d\times u/v)/n$ is satisfied.

16. An image forming apparatus according to claim 10, further having a common drive source for driving said plurality of developing means.

17. An image forming apparatus according to claim 10, which is capable of forming a full color toner image on the transfer medium.

18. An image forming apparatus according to claim 10, wherein when a toner image is borne at only a single location on said intermediate transfer member, a gap between areas of said intermediate transfer member on which no toner image is borne in a direction of movement of said intermediate transfer member is greater than $d\times u/v$.

19. An image forming apparatus comprising:

a movable image bearing member for bearing images to be developed; and a plurality of developing means operable for development at different locations along a peripheral surface of said image bearing member to superposition-develop images on said image bearing member with toners of plural colors, developed toner images of plural colors on said image bearing member being collectively transferred onto a transfer medium;

wherein at least one of respective gaps between adjacent ones of the plurality of toner images borne on said image bearing member is greater than a maximum length $\delta$ of a gap between adjacent ones of said plurality of developing means along the peripheral surface of said image bearing member.

20. An image forming apparatus according to claim 19, wherein said plurality of developing means do not perform respective developing operation simultaneously at any time.

21. An image forming apparatus according to claim 19, wherein the order of the developing operations of said plurality of developing means is determined to be from a most downstream one toward a most upstream one along the peripheral surface of said image bearing member, and then from the most upstream one to the most downstream one along the peripheral surface of said image bearing member.

22. An image forming apparatus according to one of claims 19 or 21, wherein gaps between adjacent transfer mediums when toner images are continuously formed on a plurality of transfer mediums include a first gap and a second gap larger than said first gap, said second gap being greater than $D\times U/V$.

23. An image forming apparatus according to claim 22, wherein said plurality of developing means includes first and second developing means, and when an area of said image bearing member which corresponds to said second gap is at a developing position in advance, a developing operation is changed over from said first developing means to said second developing means.

24. An image forming apparatus according to claim 19, wherein when the circumferential length of said image bearing member is $\tau$ and the length of the transfer medium along the peripheral surface of said image bearing member is $\rho$ and the number of the locations of the toner images borne on said image bearing member is n, $\rho<(\tau-\delta)/n$ is satisfied.

25. An image forming apparatus according to claim 19, further having a common drive source for driving said plurality of developing means.

26. An image forming apparatus according to claim 19, which is capable of forming a full color toner image on the transfer medium.

27. An image forming apparatus according to claim 10, wherein when a toner image is borne at only a single location on said image bearing member, a gap between areas of said image bearing member on which no toner image is borne along a peripheral surface of said image bearing member is greater than δ.

28. An image forming apparatus comprising:

a movable image bearing member for bearing images to be developed;

first, second and third developing means for developing images on said image bearing member with toners of different colors, the order of operation of said first, second and third developing means being from a downstream one toward an upstream one with respect to the direction of movement of said image bearing member, and then from a most upstream one to a most downstream one with respect to the direction of movement of said image bearing member; and a transfer medium carrying member capable of carrying a transfer medium thereon and conveying the transfer medium to a transfer position a plurality of times, a plurality of toner images on said image bearing member being superposition-transferred onto a transfer medium carried on said transfer medium carrying member at said transfer position, said transfer medium carrying member being capable of carrying a plurality of transfer mediums at different locations thereon;

wherein respective gaps between adjacent ones of the plurality of transfer mediums carried on said transfer medium carrying member include a first gap and a second gap larger than said first gap, and when an area of said image bearing member which corresponds to said second gap is at a developing position in advance, a developing operation is changed from said first developing means to said second developing means.

29. An image forming apparatus according to claim 28, wherein said first, second and third developing means are not operated for development at the same time.

30. An image forming apparatus according to claim 28, further having a common drive source for driving said first, second and third developing means.

31. An image forming apparatus according to claim 28, which is capable of forming a full color toner image on the transfer medium.

32. An image forming apparatus comprising:

a movable image bearing member for bearing images to be developed;

first and second developing means for developing images on said image bearing member with toners of different colors;

an intermediate transfer member on which toner images of plural colors on said image bearing member are superposed, said intermediate transfer member being capable of bearing a plurality of toner images at different locations thereon, with respective gaps therebetween, the toner images on said intermediate transfer member being transferred onto a transfer medium;

wherein respective gaps between adjacent ones of the plurality of toner images borne on said intermediate transfer member include a first gap and a second gap larger than said first gap, and when an area of said image bearing member which corresponds to said second gap is at a developing position in advance, a developing operation is changed over from said first developing means to said second developing means.

33. An image forming apparatus according to claim 32, wherein said first and second developing means are not operated for development at the same time.

34. An image forming apparatus according to claim 33, further having a common drive source for driving said first and second developing means.

35. An image forming apparatus according to claim 33, which is capable of forming a full color toner image on the transfer medium.

36. An image forming apparatus according to claim 33, further including third developing means for developing images on said image bearing member, and wherein the order of operation of said first, second and third developing means is determined to be from a downstream one toward an upstream one with respect to a direction of movement of said image bearing member, and then from a most upstream one to a most downstream one with respect to said direction of movement.

37. An image forming apparatus comprising:

a movable image bearing member for bearing images to be developed;

a plurality of developing means for developing images on said image bearing member with toners at a developing position, wherein plural developing means do not perform respective developing operations simultaneously at any time; and a transfer medium carrying member capable of carrying a transfer medium thereon and conveying the transfer medium to a transfer position a plurality of times, a plurality of toner images on said image bearing member being superposition-transferred onto a transfer medium carried on said transfer medium carrying member at said transfer position, said transfer medium carrying member being capable of carrying a plurality of transfer mediums at different locations thereon, respective gaps between adjacent ones of the plurality of transfer mediums carried on said transfer medium carrying member including a first gap and a second gap larger than said first gap, wherein when a length along a direction opposite a direction of movement of said image bearing member from an area on said image bearing member located at the developing position of said developing means upon completion of a developing operation by one of said plurality of developing means to an area on said image bearing member located at the developing position of said developing means upon start of a developing operation by another one of said plurality of developing means for performing a successive developing operation is defined as $L_1$, a peripheral velocity of said transfer medium carrying member is defined as U, and a peripheral velocity of said image bearing member is defined as V, respectively, the second gap is larger than $L_1 \times U/V$.

38. An image forming apparatus according to claim 37, wherein the first gap is smaller than $L_1 \times U/V$.

39. An image forming apparatus according to claim 37 or 38, wherein the order of developing operations of said plurality of developing means is from a downstream one toward an upstream one with respect to a direction of movement of said image bearing member, and then from a most upstream one to a most downstream one with respect to the direction of movement of said image bearing member.

40. An image forming apparatus according to claim 37 or 38, wherein said plurality of developing means includes first and second developing means, and when the area of said image bearing member which corresponds to said second gap is at a developing position in advance, a developing operation is changed over from said first developing means to said second developing means.

41. An image forming apparatus according to claim 37, further having a common drive source for driving said plurality of developing means.

42. An image forming apparatus according to claim 37, which is capable of forming a full color toner image on the transfer medium.

43. An image forming apparatus according to claim 37, wherein when only one transfer medium is carried on said transfer medium carrying member, a gap between areas of said transfer medium carrying member on which no transfer medium is carried in a direction of movement of said transfer medium carrying member is greater than $L_1 \times U/V$.

44. An image forming apparatus comprising:

a movable image bearing member for bearing images to be developed;

a plurality of developing means for developing images on said image bearing member with toners at a developing position, wherein said plurality of developing means do not perform respective developing operations simultaneously at any time;

an intermediate transfer member on which a plurality of toner images on said image bearing member are superposed, said intermediate transfer member being capable of bearing a plurality of toner images at different locations thereon, with respective gaps therebetween, the toner images on said intermediate transfer member being transferred onto a transfer medium, wherein respective gaps between adjacent ones of the plurality of toner images borne on said intermediate transfer member include a first gap and a second gap larger than said first gap;

wherein when a length along a direction opposite a direction of movement of said image bearing member from an area on said image bearing member located at a developing position of said developing means upon completion of a developing operation by one of said plurality of developing means to an area on said image bearing member located at a developing position of another one of said plurality of developing means upon start of a developing operation by said developing means performing a successive developing operation is defined as $L_2$, a peripheral velocity of said intermediate transfer member is defined as u, and a peripheral velocity of said image bearing member is defined as v, respectively, the second gap is larger than $L_2 \times u/v$.

45. An image forming apparatus according to claim 44, wherein the first gap is smaller than $L_2 \times U/v$.

46. An image forming apparatus according to claim 44 or 45, wherein the order of developing operations of said plurality of developing means is from a downstream one toward an upstream one with respect to the direction of movement of said image bearing member, and then from a most upstream one to a most downstream one with respect to the direction of movement of said image bearing member.

47. An image forming apparatus according to claim 44 or 45, wherein said plurality of developing means includes first and second developing means, and when an area of said image bearing member which corresponds to said second gap is at a developing position in advance, a developing operation is changed over from said first developing means to said second developing means.

48. An image forming apparatus according to claim 44, further comprising a common drive source for driving said plurality of developing means.

49. An image forming apparatus according to claim 44, which is capable of forming a full color toner image on the transfer medium.

50. An image forming apparatus according to claim 44, wherein when a toner image is borne at only a single location on said intermediate transfer member, a gap between areas of said intermediate transfer member on which no toner image is borne in a direction of movement of said intermediate transfer member is greater than $L_2 \times u/v$.

51. An image forming apparatus comprising:

a movable image bearing member for bearing images to be developed;

a plurality of developing means operable for development at different locations along a peripheral surface of said image bearing member to develop images on said image bearing member with toners of plural colors, wherein the number of said plurality of developing means is greater than three, and the order of developing operations of said plurality of developing means is determined to be from a downstream one toward an upstream one with respect to a direction of movement of said image bearing member, and then from a most upstream one to a most downstream one with respect to the direction of movement of said image bearing member;

a transfer medium carrying member for carrying a transfer medium thereon and conveying the transfer medium to a transfer position, developed toner images of plural colors on said image bearing member being superposition-transferred onto a transfer medium carried on said transfer medium carrying member, said transfer medium carrying member being capable of carrying a plurality of transfer mediums at different locations thereon, wherein respective gaps between adjacent ones of a plurality of transfer mediums carried on said transfer medium carrying member include a first gap and a second gap larger than said first gap; and wherein, when a maximum length of a gap between adjacent ones of said plurality of developing means along the peripheral surface of said image bearing member is D, a peripheral velocity of said transfer medium carrying member is U, and a peripheral velocity of said image bearing member is V, said second gap is greater than $D \times U/V$.

52. An image forming apparatus according to claim 51, wherein the first gap is greater than $D \times U/V$.

53. An image forming apparatus according to claim 51, wherein said plurality of developing means do not perform respective developing operations simultaneously at any time.

54. An image forming apparatus according to claim 51 or 52, further comprising a common drive source for driving said plurality of developing means.

55. An image forming apparatus according to claim 51, wherein said apparatus forms a full color toner image on the recording medium.

56. An image forming apparatus according to claim 51, wherein an image developed by the most downstream developing means among said plurality of developing means is transferred to the recording medium first.

57. An image forming apparatus comprising:

a movable image bearing member for bearing images to be developed:

a plurality of developing means operable for development at different locations along a peripheral surface of said image bearing member to develop images on said image bearing member with toners of plural colors, wherein the number of said plurality of developing means is greater than three, and the order of developing operations of said plurality of developing means is determined to be from a downstream one toward an upstream one with respect to a direction of movement of said image bearing member, and then from a most upstream one to a most downstream one with respect to the direction of movement of said image bearing member;

an intermediate transfer member onto which toner images of plural colors on said image bearing member are superposition transferred, said intermediate transfer member being capable of bearing a plurality of toner images at different locations thereon, with respective gaps therebetween, the toner images on said intermediate transfer member being transferred onto a transfer medium, wherein respective gaps between adjacent ones of the plurality of toner images borne on said intermediate transfer member include a first gap and a second gap larger than said first gap;

wherein when a maximum length of a gap between adjacent ones of said plurality of developing means along a peripheral surface said image bearing member is d, a peripheral velocity of said intermediate transfer member is u, and a peripheral velocity of said image bearing member is v, said second gap is greater than d×u/v.

58. An image forming apparatus according to claim 57, wherein the first gap is greater than d×u/v.

59. An image forming apparatus according to claim 57, wherein said plurality of developing means do not perform respective developing operations simultaneously at any time.

60. An image forming apparatus according to claim 57 or 59, further comprising a common drive source for driving said plurality of developing means.

61. An image forming apparatus according to claim 57, wherein said apparatus forms a full color toner image on the recording medium.

62. An image forming apparatus according to claim 57, wherein an image developed by the most downstream developing means among said plurality of developing means is transferred to the intermediate transfer member first among the plurality of images superposition transferred to the intermediate transfer member.

* * * * *

UNITED STATES PATENT AND TRADEMARK OFFICE

CERTIFICATE OF CORRECTION

PATENT NO. : 5,636,010 Page 1 of 3

DATED : June 3, 1997

INVENTOR(S) : TOSHIMITSU DANZUKA, ET AL.

It is certified that error appears in the above-indentified patent and that said Letters Patent is hereby corrected as shown below:

COLUMN 2:

Line 50, "is" should read --is:--.

COLUMN 3:

Line 36, "color" should read --blue color--; and
Line 67, "is" should --is:--.

COLUMN 5:

Line 54, "equation" should read --equation:--; and
Line 55, "$Q < (T\text{-}DxU/V)/n$" should read --$Q < (T\text{-}DxU/V)/n$,--.

UNITED STATES PATENT AND TRADEMARK OFFICE

CERTIFICATE OF CORRECTION

PATENT NO. : 5,636,010

DATED : June 3, 1997

INVENTOR(S) : TOSHIMITSU DANZUKA, ET AL.

It is certified that error appears in the above-indentified patent and that said Letters Patent is hereby corrected as shown below:

COLUMN 7:

Line 20, "is," should read --is $t$,--;
Line 23, "is," should read --is $d$,--;
Line 24, "is," should read --is $u$,--;
Line 30, "equation" should read --equation:--; and
Line 34, "$q < (t\text{-}dxu/v)/n$" should read --$q < (t\text{-}dxu/v)/n$,--.

COLUMN 8:

Line 23, "the" (second occurrence) should be deleted;
Line 37, "equation" should read --equation:--; and
Line 40, "$p < (T\text{-}\delta/n$" should read --$p < (T\text{-}\delta/n$,--.
Line 49, "which" should be deleted.

COLUMN 10:

Line 50, "one of" should be deleted; and
Line 52, "when" should be deleted.

UNITED STATES PATENT AND TRADEMARK OFFICE

CERTIFICATE OF CORRECTION

PATENT NO. : 5,636,010 Page 3 of 3

DATED : June 3, 1997

INVENTOR(S) : TOSHIMITSU DANZUKA, ET AL.

It is certified that error appears in the above-identified patent and that said Letters Patent is hereby corrected as shown below:

COLUMN 11:

Line 50, "one of" should be deleted.

COLUMN 12:

Line 39, "one of" should be deleted.

COLUMN 15:

Line 47, "$L_2 \times U/v$." should read --$L_2 \times u/v$."

COLUMN 18:

Line 20, "superposition transferred" should read --superposition-transferred--.

Signed and Sealed this

Ninth Day of December, 1997

Bruce Lehman

*Attest:*

BRUCE LEHMAN

*Attesting Officer*

*Commissioner of Patents and Trademarks*